US006679410B2

(12) United States Patent
Würsch et al.

(10) Patent No.: US 6,679,410 B2
(45) Date of Patent: Jan. 20, 2004

(54) SETTING TOOL WITH A SETTING DEPTH CONTROL

(75) Inventors: Christoph Würsch, Werdenberg (CH); Albert Binder, Buchs (CH); Harald Schmitzer, Wasserburg (DE); Wolfgang Zesch, Zurich (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/197,174

(22) Filed: Jul. 16, 2002

(65) Prior Publication Data

US 2003/0015088 A1 Jan. 23, 2003

(30) Foreign Application Priority Data

Jul. 19, 2001 (EP) ..... 01810717

(51) Int. Cl.[7] ..... B25C 1/04
(52) U.S. Cl. ..... 227/2; 227/10; 227/142
(58) Field of Search ..... 227/8, 10, 130, 227/142, 2, 4, 156

(56) References Cited

U.S. PATENT DOCUMENTS

| | | | | |
|---|---|---|---|---|
| 4,534,500 A | * | 8/1985 | Jochum | 227/156 |
| 5,957,362 A | * | 9/1999 | Samulowitz et al. | 227/2 |
| 6,216,935 B1 | * | 4/2001 | Oussani, Jr. et al. | 227/142 |
| 6,431,425 B1 | * | 8/2002 | Moorman et al. | 227/2 |
| 6,446,319 B1 | * | 9/2002 | Lulay et al. | 227/2 |
| 6,471,106 B1 | * | 10/2002 | Reining | 227/156 |
| 6,481,608 B2 | * | 11/2002 | Wohlwend et al. | 227/142 |

* cited by examiner

*Primary Examiner*—Scott A. Smith
(74) *Attorney, Agent, or Firm*—Sidley Austin Brown & Wood, LLP

(57) ABSTRACT

An explosive powder charge-operated setting tool having a drive piston (4) for driving a pin-shaped nail (5) in a constructional component in a single drive-in step, and a control circuit (I) for controlling a setting depth (T) and including control electronics (7), a set point generator (8) for setting the setting depth (T), a position-determining sensor (9) for determining a position of a lower dead point (uTP) of movement of the drive piston (4), and a regulator (10) for an automatic adjustment of a motion energy of the drive piston; and a method of controlling the setting depth (T).

15 Claims, 2 Drawing Sheets

SETTING TOOL WITH A SETTING DEPTH CONTROL

BACKGROUND OF THE INVENTION

1. Field of the Invention

The present invention relates to a setting tool for setting pin-shaped elements and including means for controlling the setting depth, and to a method of controlling the setting depth.

2. Description of the Prior Art

With conventional setting tools of the type discussed above, a drive piston, which is accelerated usually as a result of an explosion of an explosive powder charge cartridge or combustion of a gas mixture in a combustion chamber of the tool, drives, e.g., a pin-shaped nail in a constructional component.

The pin-shaped nail is driven in the constructional component as a result of application of the motion energy of the drive piston thereto. The motion energy is determined by the hardness of the constructional component into which the nail is to be driven, and by the desired setting depth. The required motion energy is obtained by selecting an appropriate explosive powder cartridge or a gas mixture composition, by choosing an appropriate combustion chamber volume, an initial position of the drive piston and corresponding damping means. Usually, preliminary tests are conducted in order to determine a necessary time period and consumption of the material.

German Publication DE-3930592A1 discloses an explosive powder charge-operated setting tool having a drive piston and elastic damping elements which permit to control the setting depth. In the known setting tool, the setting depth for a following nail is adjusted by manually adjusting the initial position of the drive piston relative to the corresponding damping elements.

European Publication EP-338257B1 discloses a percussion tool with an electronic control of the impact energy for following each other impacts applied to the same nail. The impact energy of a following impact applied to the same nail is determined in accordance with a stored control function for a current conduction angle of the electromagnetic percussion mechanism and in accordance with a change of a penetration depth resulting from application of a previous impact. The change of the penetration depth is determined with an optical or magnetic incremental position sensor that determines a position of the electromagnetically driven drive piston with reference to the position of the lower dead point of the drive piston movement. After the predetermined set value of the setting depth is reached, which is determined by addition of changes of penetration depths caused by separate impacts or by an end position sensor, the drive-in process ends, and the impact energy control for a following drive-in process is initiated. The foregoing impact energy control of separate impacts applied to the same nail cannot be used in setting tool with a single drive-in impact or step.

Accordingly, an object of the present invention is to provide a setting tool with a setting depth control for a single drive-in step.

Another object of the present invention is to provide a method of controlling a setting depth in single drive-in step setting tools.

SUMMARY OF THE INVENTION

These and other objects of the present invention, which will become apparent hereinafter, are achieved by providing an explosive powder charge-operated setting tool including a drive piston, which is driven by an expandable, in a combustion chamber, propellant, for driving a pin-shaped nail in a constructional component in a single drive-in step, and a control circuit for controlling a setting depth and having control electronics, a set point generator for setting the setting depth, a position sensor for determining a position of a lower dead point of the movement of the drive piston, and a regulator for an automatic adjustment of a motion energy of the drive piston; and by providing a method of controlling the setting depth and including:

initiating a drive-in process;

numerically determining a position of the drive piston during the drive-in process with the position sensor, and determining a position of a lower dead point of the movement of the drive piston in response to signals generated by the position-determining sensor;

generating, based on the position of the lower dead point and a set value of the setting depth, a control variable for a following drive-in process;

temporary storing the control variable as a setup variable for a following drive-in process;

adjusting the motion energy of the drive piston with the regulator in accordance with the temporary stored setup or control variable; and effecting the following drive-in process.

During the following drive-in steps, the above-described four steps are periodically repeated, whereby in the second drive-in step, an automatic regulation takes place.

In accordance with the setting depth of the last driven-in nail, which is determined with the position sensor, the control electronics determines the motion energy for the following drive-in step for driving-in of the next nail. The motion energy value is temporary stored by the motion energy regulator. Thereby, a setting depth, which was achieved in a single drive-in step in accordance with a predetermined set value, is reached in several following each other steps.

Advantageously, the regulator is formed as an electrically controlled mechanical actuator which also controls in per se known manner the amount of propellant, mixing ratio, combustion chamber volume, propellant drain means, and/or the position of the damping means.

Advantageously, the position sensor is formed as an incremental sensor for sensing of a plurality of axially equidistant, advantageously, rotationally symmetrical marks provided on the drive piston. Advantageously, the position sensor is associated with a counter integrated in control electronics, whereby a small and robust construction of the position sensor is obtained.

Advantageously, the incremental sensor is formed as a magnetic field-sensing semiconductor sensor, such as a magneto-resistance sensor or as a Hall-sensor, for sensing sensor mark-forming projections and depressions which are provided on the drive piston and which modulate a permanent magnetic field generated at a location of the semiconductor sensor, advantageously, by a permanent magnet.

Advantageously, the sensor marks are formed as small residual webs provided between respective two closely adjacent annular grooves. The sharp curvature of the surfaces of the projecting webs insures that the measured variable, which is determined by the change of the magnetic field, is sufficiently large. On the other hand, the fatigue notch factor of the annular groove for the remaining cross-section of the drive piston, which is subjected to high mechanical alternating stresses, is rather small.

Advantageously, the incremental sensor is formed of at least two sensor elements which are connected with each other in antiphase for measuring differential measurement value data.

The formation of the sensor in above-described manner permits to practically eliminate fluctuations of absolute measurement values which can result from a radial backlash of set pins in their guide and that can reach up to 0.6 mm.

Advantageously, the two sensor elements are axially offset relative to each other by a one-fourth (¼) of a distance between two adjacent sensor marks. This permits to determine, over the time rank, a change of the measurement value registered in both sensor elements by using quadrature detection of the direction of the axial movement of the nail. Whereby, the lower dead point of the drive piston movement, in particular, can be reliably determined upon change of the direction.

Advantageously, the position sensor is associated with a timer, which permits to reliably detect the lower dead point over the time maximum. In addition, in connection with the spacing between the sensor marks, the speed of the set nail, which is correlated with the setting energy, can be calculated. Also, the determination of the hardness of the constructional component by using the Windsor method becomes possible. This hardness as well as the setting depth can be displayed.

The novel features of the present invention, which are considered as characteristic for the invention, are set forth in the appended claims. The invention itself, however, both as to its construction and its mode of operation, together with additional advantages and objects thereof, will be best understood from the following detailed description of the preferred embodiment, when read with reference to the accompanying drawings.

DETAILED DESCRIPTION OF THE PREFERRED EMBODIMENT

Figure 1:
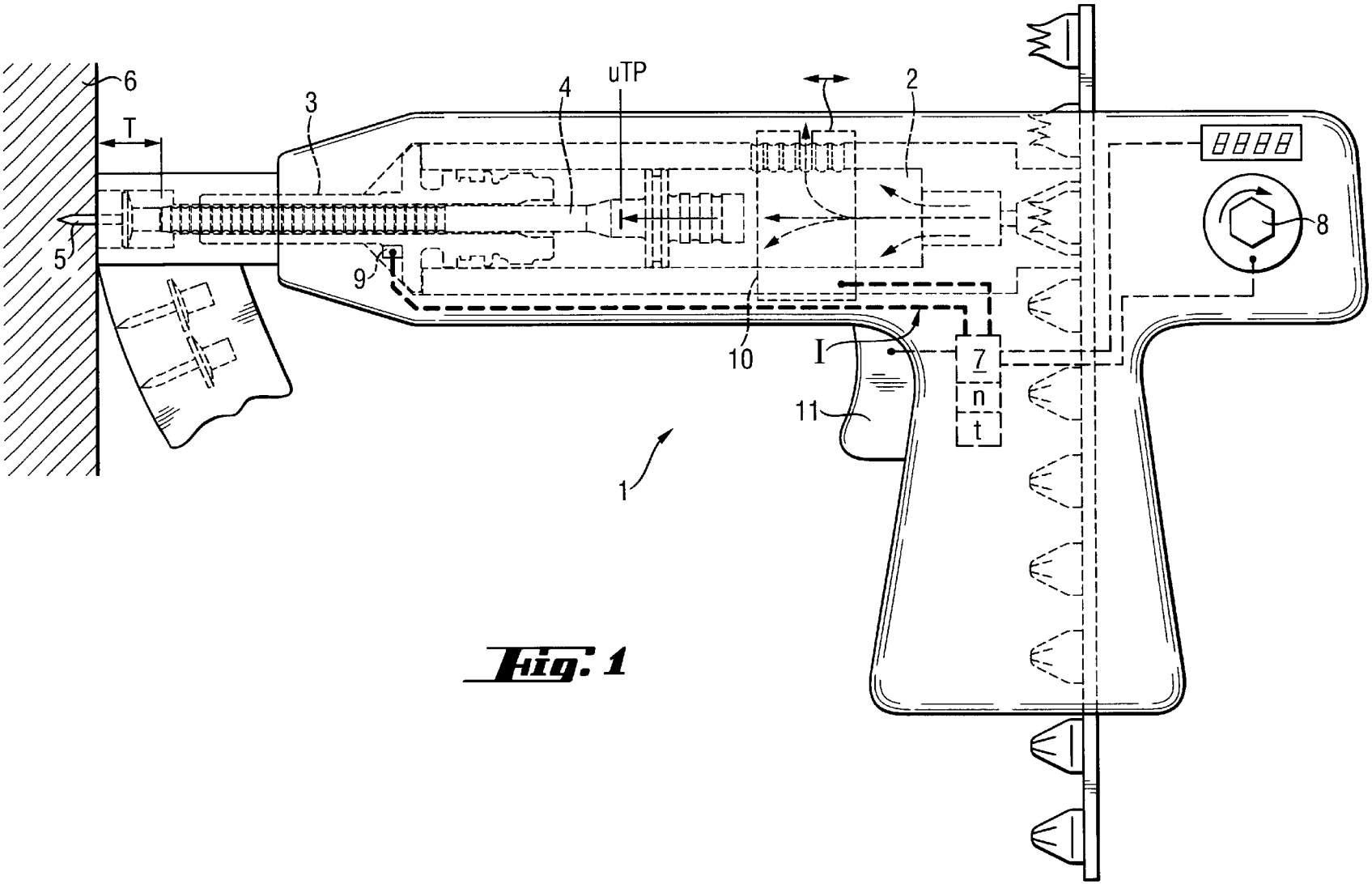
FIG. 1 shows a schematic view of an explosive powder charge-operated setting tool according to the present invention.
Figure 2:
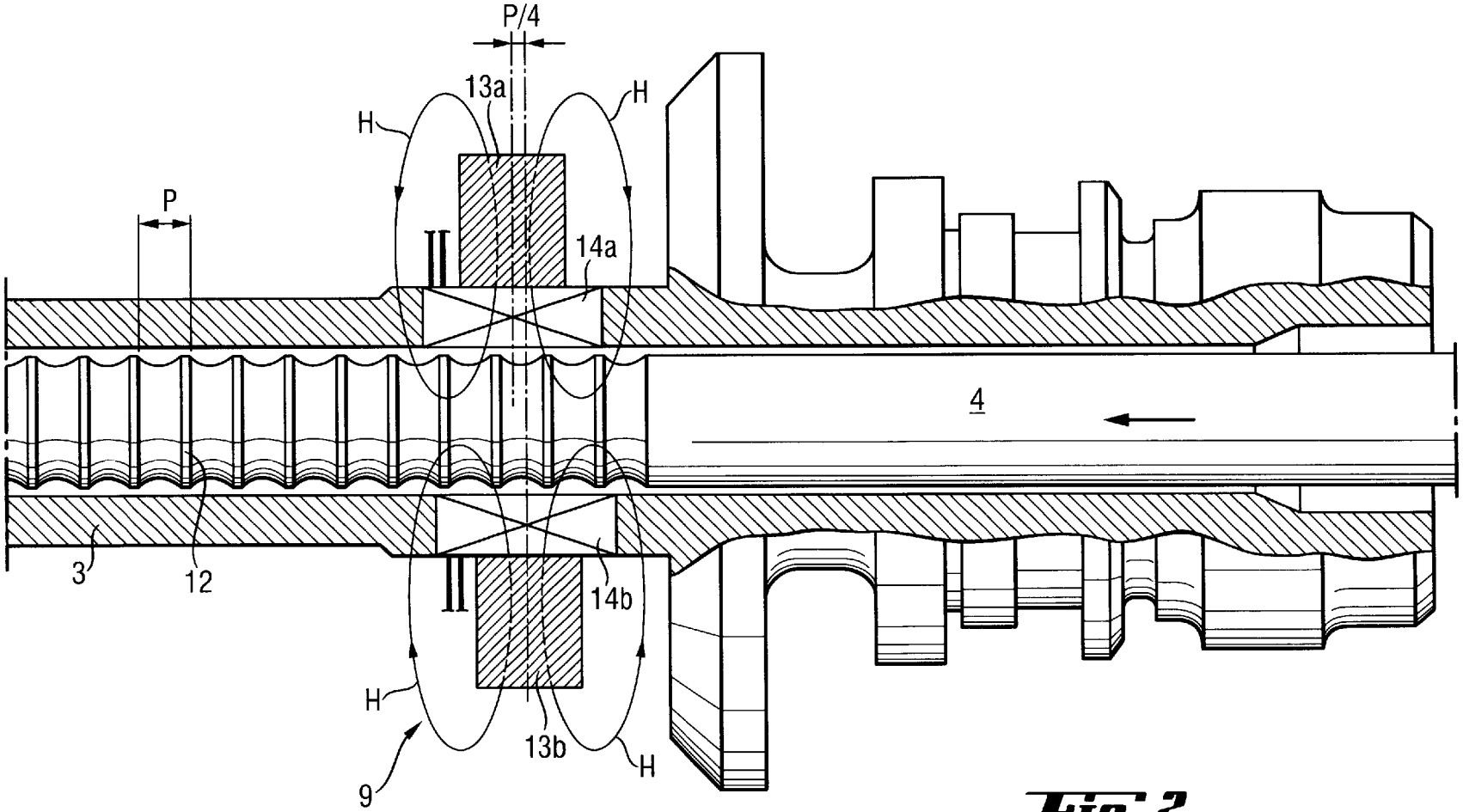
FIG. 2 shows a cross-sectional view of a unit of the tool shown in FIG. 1 with a position sensor.

An explosive powder charge-operated setting tool 1, which is shown in the drawings, includes a drive piston 4 for driving-in of a pin-shaped nail 5, which is arranged along the tool axis, into a constructional component 6. The drive piston 4 is axially displaceable, by a predetermined limited amount, in a guide 3 and is driven by an expandable propellant of a powder charge cartridge located in a combustion chamber 2. An electromechanical control circuit I, which is shown with thick black lines in FIG. 1, controls the displacement of the drive piston 4 to a dead point uTP or a corresponding setting depth T. The control circuit I includes control electronic means 7 in form of a microcontroller with an integrated counter n and a timer t. The microcontroller 7 is operatively connected with a rotatably adjustable, set point generator 8 for setting the setting depth T, a position sensor 9 arranged in the guide 3, a regulator 10 formed as a controllable, mechanical actuator, and an actuation switch 11. The microcontroller 7 is also connected with a numerical display that shows the setting depth T and hardness of the constructional component 6.

The position determining sensor 9 is formed as an incremental Hall sensor. The drive piston 4, which is formed of a ferromagnetic material, has a plurality of equidistantly spaced, rotationally symmetrical sensor marks 12 in form of small residual webs which are formed between two closely adjacent annular grooves having a depth of about 0.5 mm and a width of about 2.5 mm. The sensor marks 12, which are spaced from each other by a distance of 3 mm, are sensed by the Hall sensor. The sensor marks 12 modulate a permanent magnetic filed H which is generated by two, torus-shaped permanent magnets 13*a,* 13*b* provided adjacent to the position sensor 9, the Hall sensor. The position sensor 9 is formed of sensor elements 14*a,* 14*b* which are arranged radially diametrically opposite each other with respect to the drive piston. The sensor elements 14*a* and 14*b* are axially offset relative to each other by one fourth (¼) of the distance P between adjacent sensor marks 12.

According to the present invention, the setting depth is determined by controlling the motion energy of the drive piston 4 of the power tool. After a drive-in step has been initiated, a position of a lower dead point uTP is determined by measuring the positions of the drive piston 4 during its drive movement with the position sensor 9. Based on the position of the lower dead point uTP and a value of the setting depth T, a control variable for a next drive-in process is generated by the control electronics and is temporarily stored as a setup variable for the next drive-in step, with the regulator 10 adjusting the motion energy of the drive piston 4 for the next step.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. An explosive powder charge-operated setting tool, comprising a drive piston (4), which is driven by an expandable propellant, in a combustion chamber (2), for driving a pin-shaped nail (5) in a constructional component (6) in a single drive-in step; and a control circuit (I) for controlling a setting depth (T) and including control electronics (7), a set point generator (8) for setting the setting depth (T), a position sensor (9) for determining a position of a dead point (uTP) of the drive piston (4), and a regulator (10) for an automatic adjustment of a motion energy of the drive piston (4).

2. An explosive powder charge-operated setting tool according to claim 1, wherein the regulator (10) is formed as an electrically controlled mechanical actuator.

3. An explosive powder charge-operated setting tool according to claim 1, wherein the regulator (10) controls at least one of amount of the propellant, mixing ratio, combustion chamber volume, propellant drain means, and a position of a damping element.

4. An explosive powder charge-operated setting tool according to claim 1, wherein the drive piston (4) is provided with a plurality of axially equi-distant marks (12) which are sensed by the position sensor (9) formed as an incremental sensor.

5. An explosive powder charge-operated setting tool according to claim 4, wherein the sensor marks (12) are arranged rotationally symmetrically relative to each other.

6. An explosive powder charge-operated setting tool according to claim 4, wherein the control electronics (7)

includes a timer (t), and wherein the position sensor (9) is connected with the timer.

7. An explosive powder charge-operated setting tool according to claim 4, wherein the incremental sensor is formed as a magnetic field-sensing semiconductor sensor for sensing sensor mark-forming projections and depressions which are provided on the drive piston (4) and which modulate a permanent magnetic field generated at a location of the semiconductor sensor.

8. An explosive powder charge-operated setting tool according to claim 7, wherein the sensor marks (12) are formed as small residual webs provided between respective two closely adjacent annular grooves.

9. An explosive powder charge-operated setting tool according to claim 4, wherein the incremental sensor is formed of at least two sensor elements (14*a,* 14*b*) which are connected with each other in antiphase for measuring differential measurement value data.

10. An explosive powder charge-operated setting tool according to claim 9, wherein the at least two sensor elements (14*a,* 14*b*) are axially offset relative to each other by a one-fourth (¼) of a distance (P) between two adjacent sensor marks (12).

11. An explosive powder charge-operated setting tool according to claim 1, wherein the control electronics (7) includes a timer (t), and wherein the position sensor (9) is associated with the timer.

12. A method of controlling a setting depth (T) of a pin-shaped nail (5) driven into a constructional component with a setting tool including a drive piston (4), and a control circuit (1) for controlling a setting depth (T) and including control electronics (7), a position-determining sensor (9) for determining a position of a lower dead point (uTP) of the drive piston (4) which is correlated with the setting depth, and a regulator (10) for an automatic adjustment of a motion energy of the drive piston (4) the method comprising the steps of:

initiating a drive-in process;

numerically determining a position of the drive piston during the drive-in process with the position sensor (9) and determining a position of a lower dead point (uTP) of the movement of the drive piston (4) in response to signals generated by the position-determining sensor (9);

generating, based on the position of the lower dead point (uTP) and a set value of the setting depth (T), a control variable for a following drive-in process;

temporary storing the control variable as a setup for a following drive-in process;

adjusting motion energy of the drive piston (4) the regulator (10) in accordance with the stored control variable; and effecting the following drive-in process.

13. A method according to claim 12, wherein all of the position measuring, generating, temporary storing, and effecting steps are periodically repeated.

14. A method according to claim 12, further comprising the steps of numerically displaying the setting depth (T).

15. A method according to claim 12, further comprising the step of determining hardness of the constructional component (6) and numerically displaying the hardness.

* * * * *